US005228793A

United States Patent [19]

Ferrie

[11] Patent Number: 5,228,793

[45] Date of Patent: Jul. 20, 1993

[54] PRINTER

[75] Inventor: John J. Ferrie, Dublin, Ireland

[73] Assignee: Balmaha, Stillorgan, Ireland

[21] Appl. No.: 916,506

[22] Filed: Jul. 17, 1992

[30] Foreign Application Priority Data

Feb. 25, 1992 [IE] Ireland ..... 920596

[51] Int. Cl.[5] ..... B41J 29/02

[52] U.S. Cl. ..... 400/692; 400/208

[58] Field of Search ..... 400/120, 692, 208, 224.1

[56] References Cited

U.S. PATENT DOCUMENTS

| | | | |
|---|---|---|---|
| 4,614,949 | 9/1986 | Hakkaku et al. | 346/76 PH |
| 4,632,585 | 12/1986 | Oyamatsu et al. | 400/613 |
| 4,641,980 | 2/1987 | Matsumoto et al. | 400/120 |
| 4,754,290 | 6/1988 | Kitayama et al. | 400/120 |
| 4,896,166 | 1/1990 | Barker et al. | 400/692 |
| 4,944,619 | 7/1990 | Suzuki et al. | 400/224.2 |
| 5,011,310 | 4/1991 | Wiechert | 400/692 |
| 5,030,968 | 7/1991 | Benson et al. | 346/76 PH |

FOREIGN PATENT DOCUMENTS

| | | |
|---|---|---|
| 2121359 | 12/1983 | United Kingdom . |
| 2162794 | 2/1986 | United Kingdom . |

*Primary Examiner*—Edgar S. Burr
*Assistant Examiner*—Ren Yan
*Attorney, Agent, or Firm*—Price, Heneveld, Cooper, DeWitt & Litton

[57] ABSTRACT

A printer includes a housing containing a removable ink ribbon cartridge and a platen. In use, the platen is located over the ink ribbon in the cartridge. The platen is pivotable from the in use position to a raised position to provide clearance for removal and replacement of the cartridge.

5 Claims, 9 Drawing Sheets

PRINTER

This invention relates to a printer, for example for use as a computer output device.

A printer for use as a computer output device is described in our copending Irish Patent Application No. 4036/90. In that case a thermal print head was applied against heat sensitive paper in order to produce an image.

According to the present invention there is provided a printer comprising a housing containing a removable ink ribbon cartridge and a platen which in use of the printer is located over the ink ribbon in the cartridge, wherein the platen is movable from an in use position to a raised position providing clearance for removal and replacement of the cartridge.

An embodiment of the invention will now be described, by way of example, with reference to the accompanying drawings, in which.

Figure 4A:
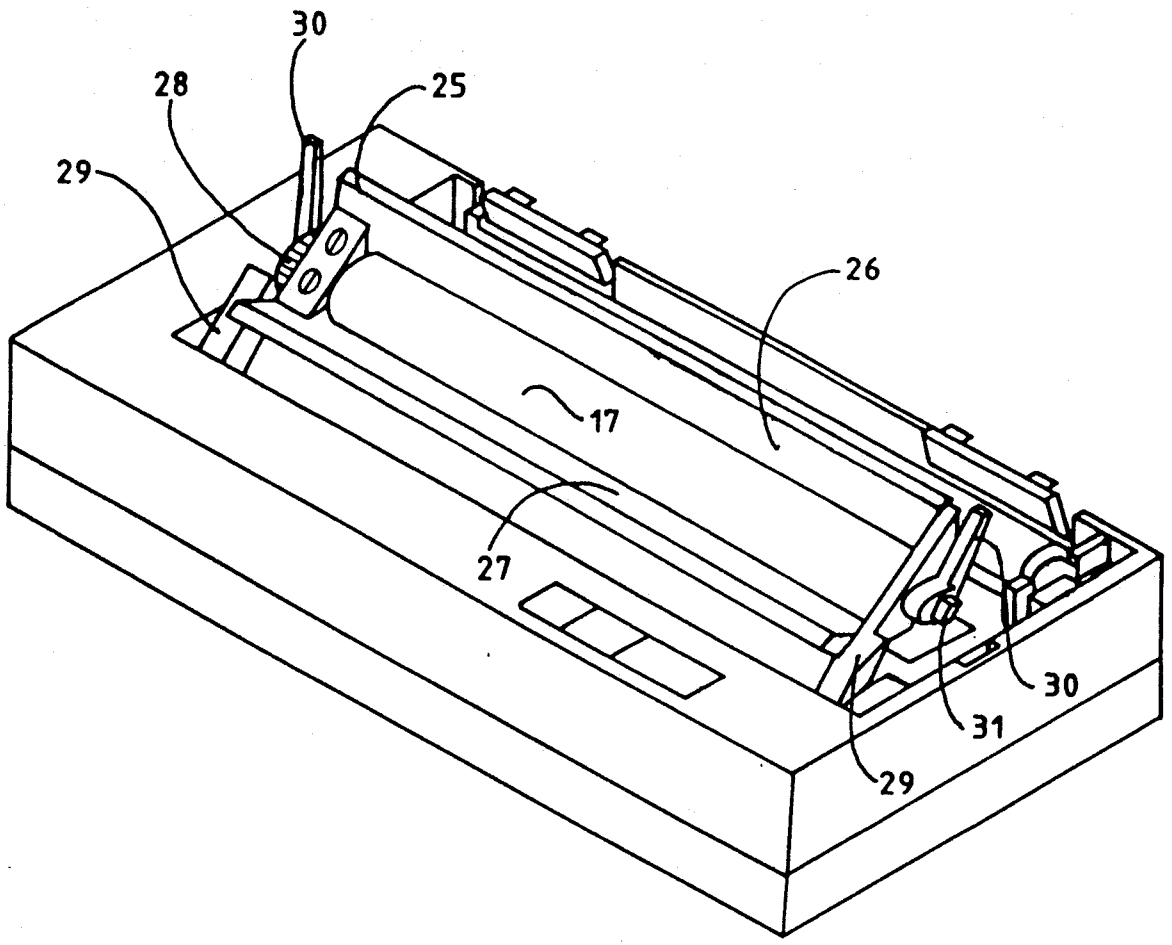
Figure 4B:
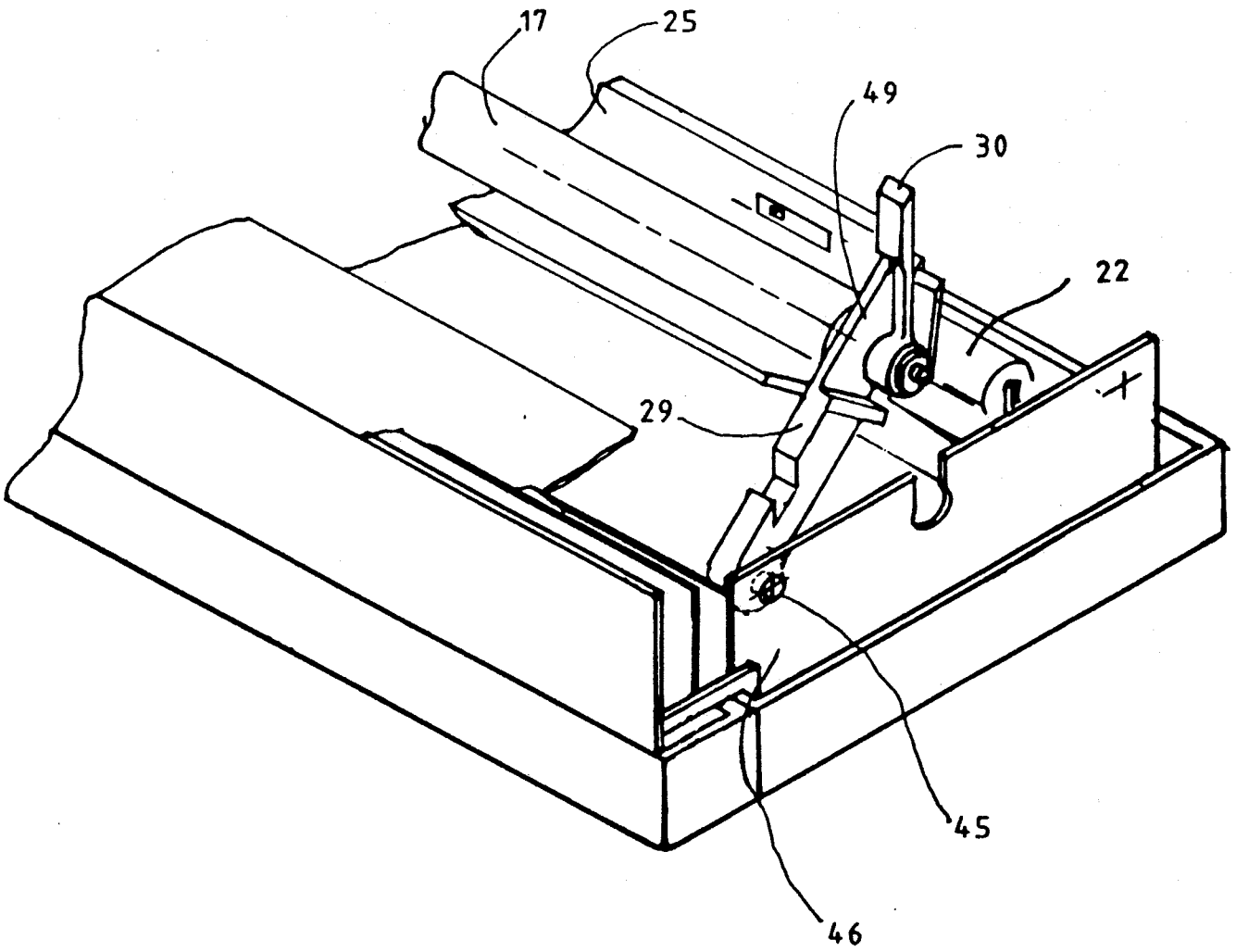

FIG. 4*a* is a perspective view of the printer with the lid omitted and showing the platen partially raised;

FIG. 4*b* is a partly broken away detailed view of the bailing arm mechanism of FIG. 4*a;*

Figure 4C:
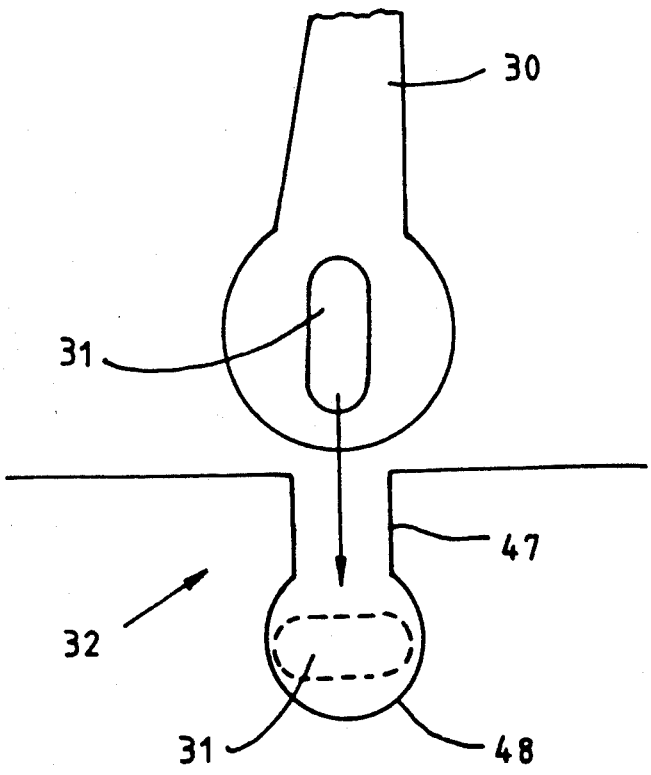
Figure 5:
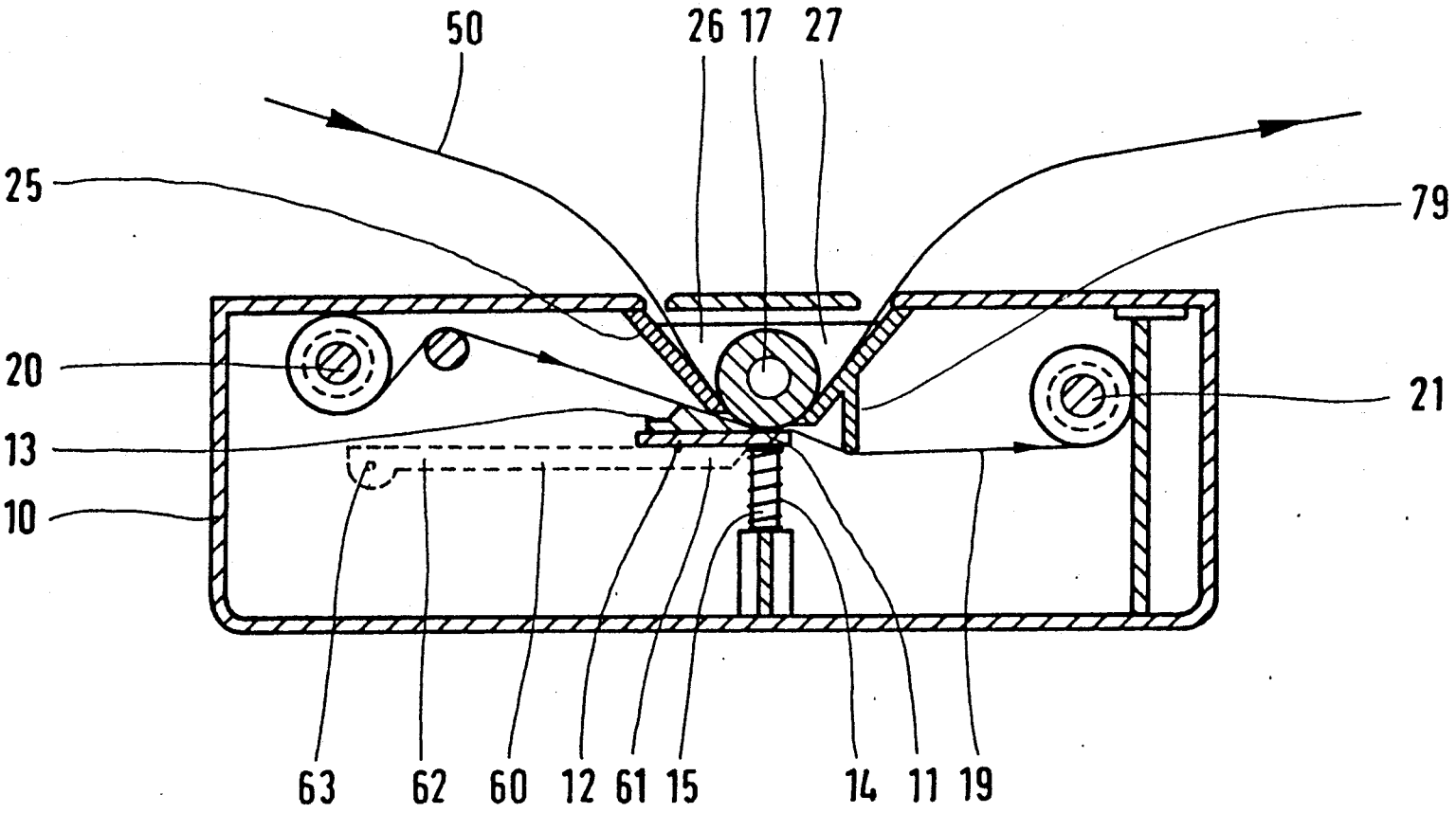
Figure 6:
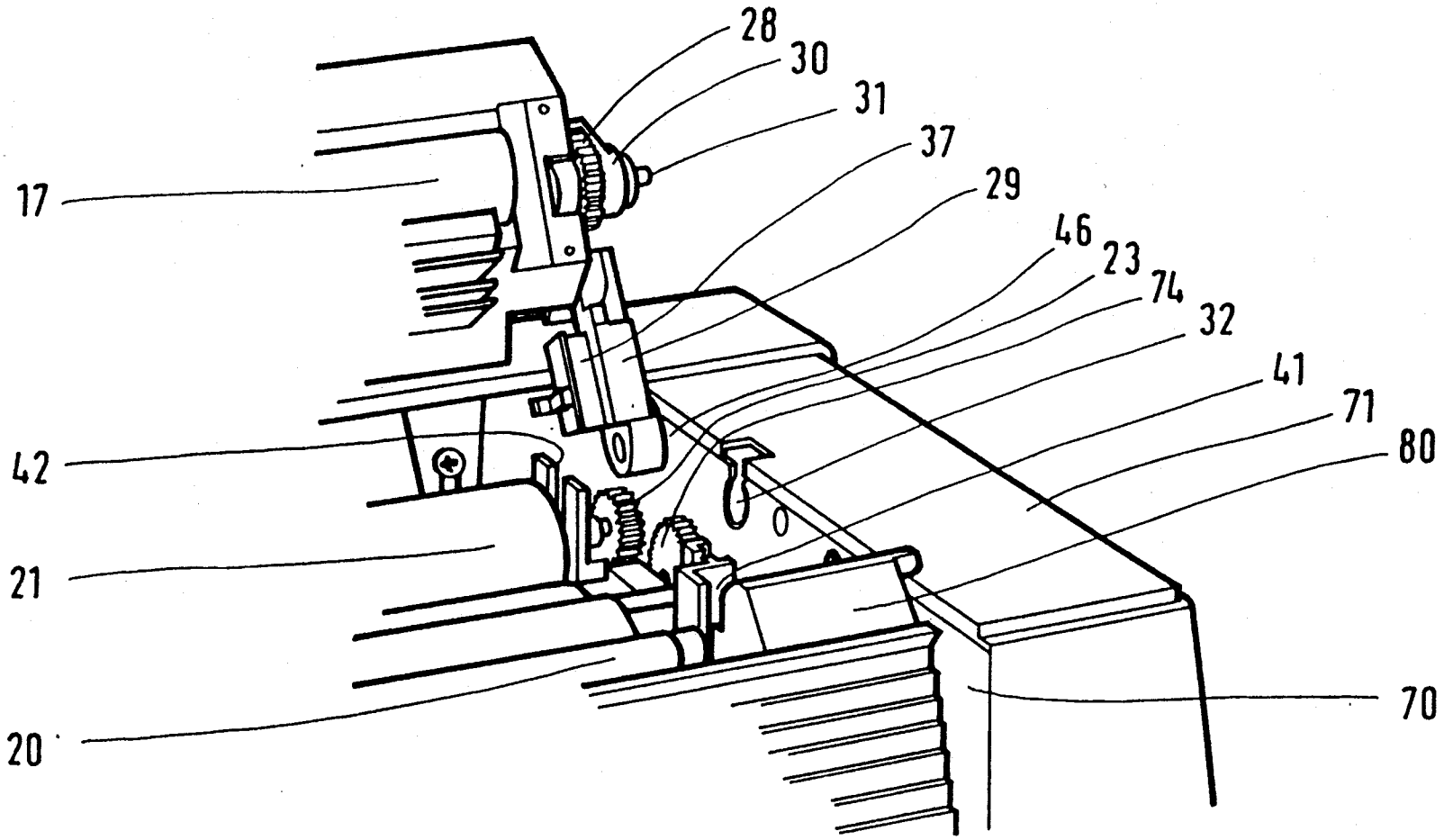
Figure 7:
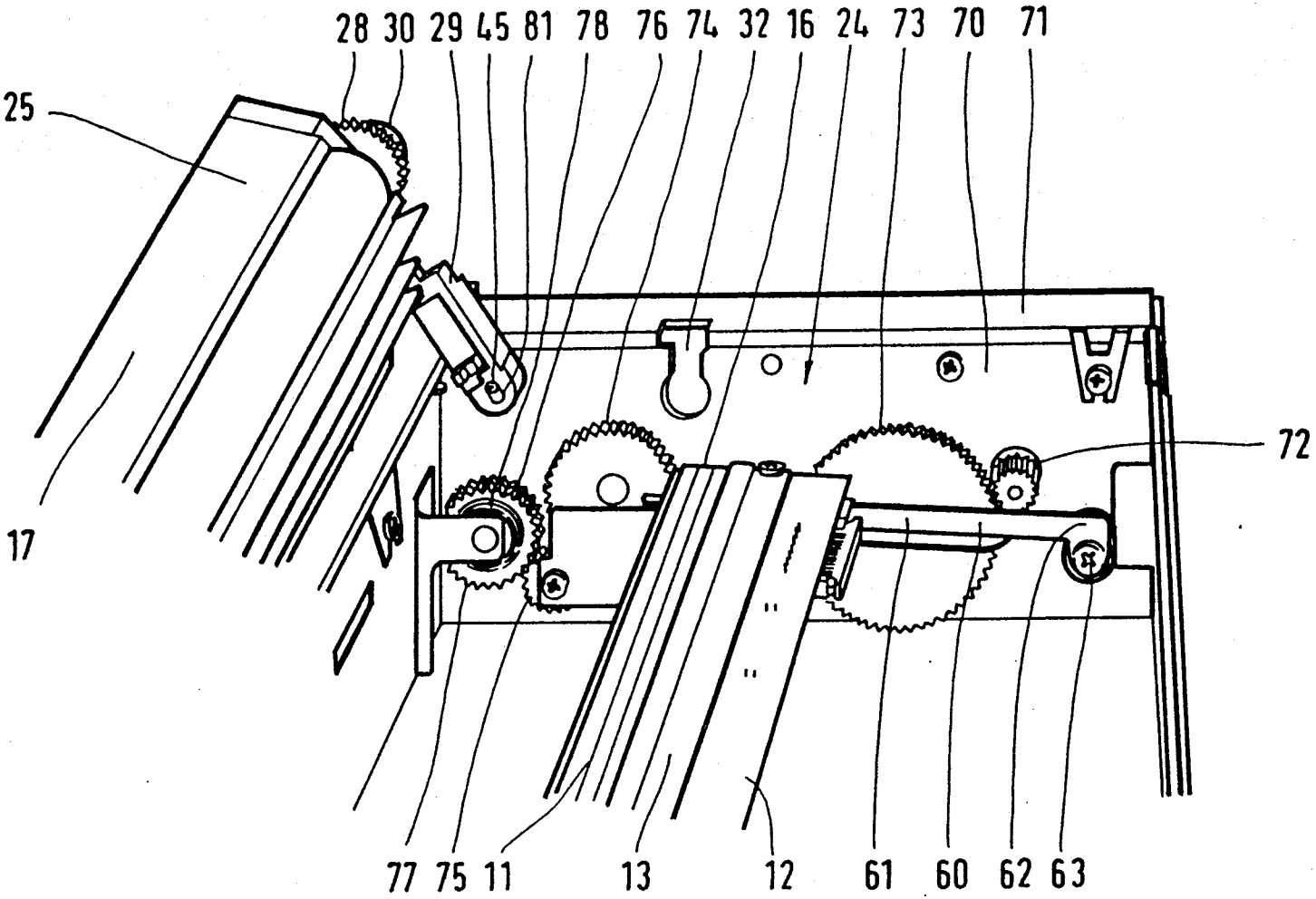

FIG. 4*c* is an enlarged view showing the engagement of the levers of FIG. 4*b* with the keyhole slot;

FIG. 5 is a cross-sectional view of the main components of the printer, taken on a vertical plane perpendicular to the axis of the platen;

FIG. 6 is a perspective view of one end of the printer with the platen fully raised for removal and replacement of the ink ribbon cartridge; and FIG. 7 is an interior view of the same end of the printer with the ink ribbon cartridge removed.

A brief description of the printer will first be given with reference to the cross-section of FIG. 5. The printer comprises a print head 11 which is biassed by springs 14 upwardly towards a rotatable cylindrical platen 17 The print head 11 includes a linear array of selectively energisable heating elements, such array and the print head 11 that carries it extending in a direction perpendicular to the plane of FIG. 5. In use, a gear train (not shown in FIG. 5) transports an ink ribbon 19 and paper 50 to be printed on together past the print head 11 in the direction shown by the arrows, the print head 11 pressing the ribbon 19 and paper 50 against the platen 17. The ink ribbon 19 is disposed between the print head 11 and the paper 50 and is coated with a meltable ink on its surface adjacent to the paper (i.e. the surface facing away from the print head 11). The heating elements are selectively energised as the ribbon 19 and paper 50 are transported past the print head 11 so that the ink ribbon 19 is selectively heated from its non-coated side and ink is selectively melted from the ink ribbon and transferred to the paper 50.

Referring now also to the rest of the Figures for a more detailed description, the printer has a generally rectangular housing 10 of moulded plastics material. The elongate thermal print head 11 is mounted within the housing 10 on the upper surface of an elongate support member 12, being clamped to such support member 12 by a clamping strip 13.

The support member 12 is mounted on a pair of parallel generally horizontal arms 60 (FIGS. 5 and 7, which are located one at each side of the interior of the printer. One end 61 of each arm 60 is fixed beneath and carries a respective end of the support member 12, while the other ends 62 of the arms 60 are freely pivoted about a common substantially horizontal axis 63 which is parallel to the print head 11. Thus the print head 11 is movable generally in the vertical direction towards and away from the cylindrical platen 17 by rotation of the arms 60 about the axis 63.

Mounted on the arms 60 the print head 11 is biassed upwardly in the housing 10 towards the platen 17 by a pair of coil springs 14. The coil springs 14 are located over respective upstanding posts 15 formed integrally with the base of the housing 10, and are maintained under compression between the base of the housing and the support member 12. The cylindrical platen 17 is mounted for rotation about its own axis, which is parallel to the print head 11.

Figure 3:
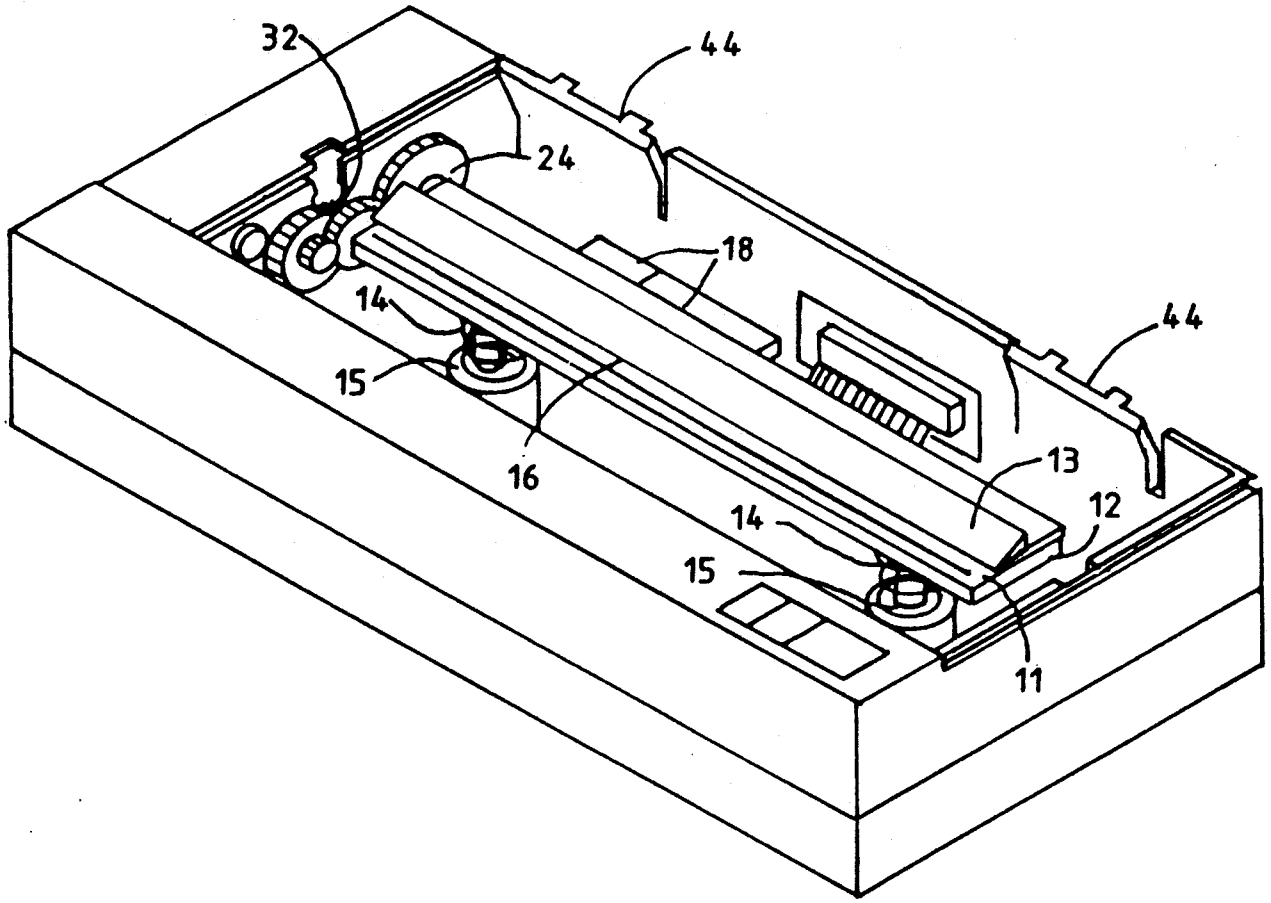
FIG. 3 is a perspective view of the printer with the lid and ink ribbon cartridge omitted.

The print head 11 includes a linear array 16 of 1,728 closely spaced heating elements, FIGS. 3 and 7, overall wide enough to accommodate the width of an 216 mm sheet. The linear array 16 is exposed on the surface of the support member 12, and it is the array 16 which is biassed against the underside of the platen 17. The individual heating elements are slightly raised so that pressure between the print head 11 and platen 17 is focussed at these points. The thermal print head 11 may be of the type TPH216R55, produced by Toshiba.

Figure 1:
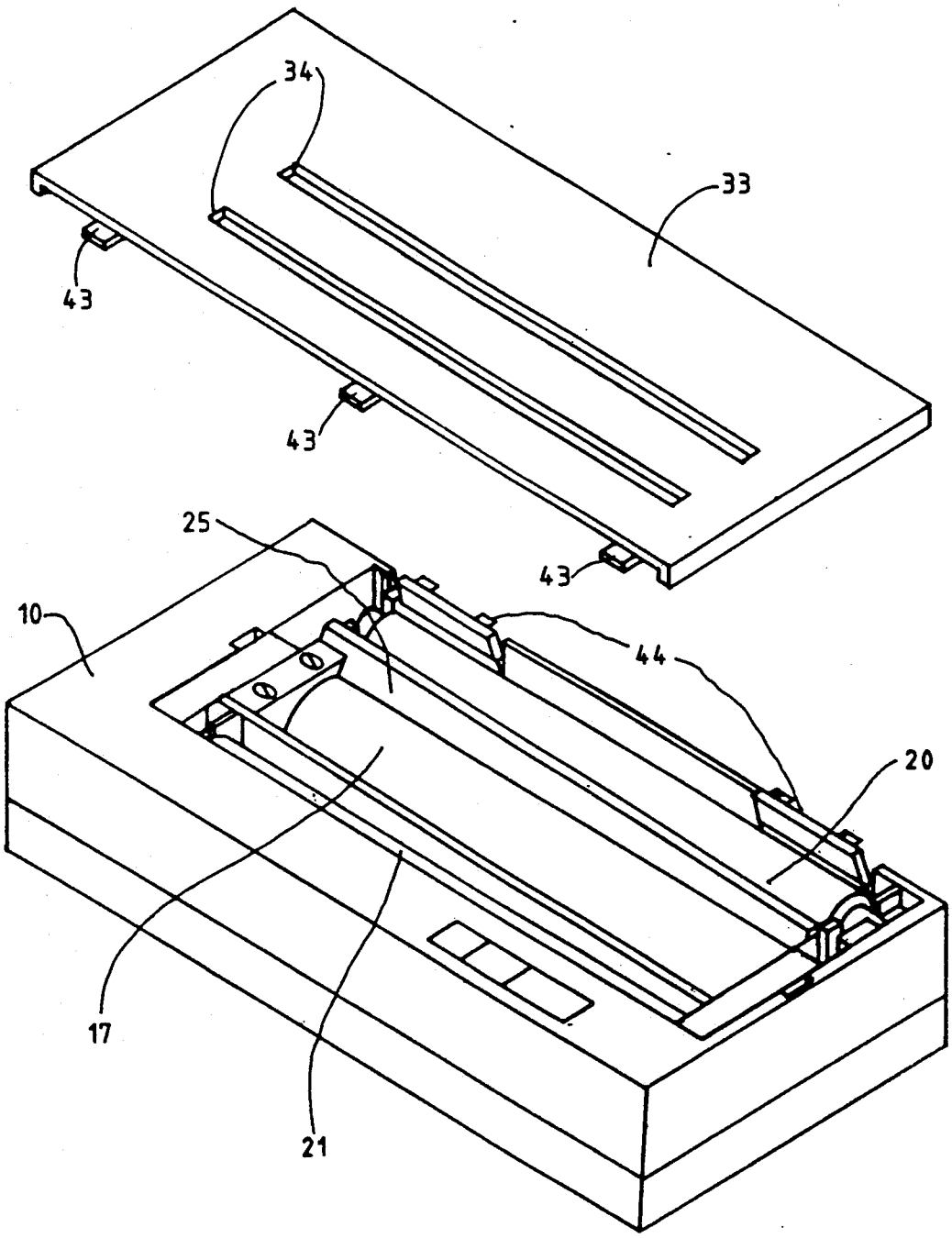
FIG. 1 is a perspective view, with the lid removed, of a printer according to the embodiment.
Figure 2:
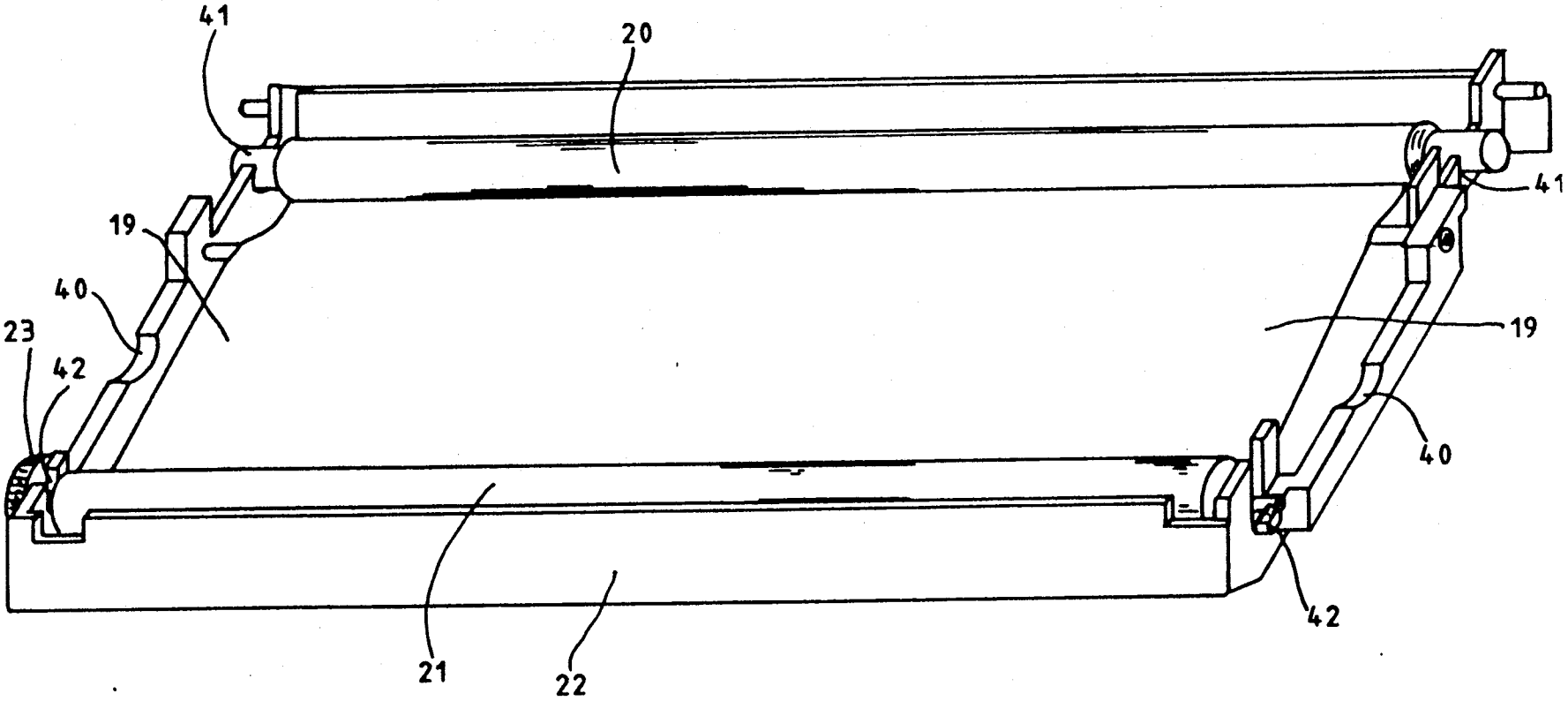
FIG. 2 is a perspective view of the ink ribbon cartridge forming part of the printer of FIG. 1.

The ink ribbon 19 is accommodated on a dispensing roll 20 in a removable cartridge 22 (FIG. 2 and in use is fed to a take-up roll 21. The rolls 20 and 21 are located parallel to one another along opposite edges of the cartridge 22, their ends sitting in respective slots or recesses 41 and 42 of the cartridge.

The cartridge 22 is a simple open frame designed to hold the two rolls 20 and 21 such that it sits into the housing 10 and may simply be lifted out when replacement of the ink ribbon 19 is required. The platen 17 when in its operative position sits between recesses 40. The axes of the rolls 20 and 21 are parallel to the print head 11 and to axis of the platen 17.

The cartridge 22 is mounted above the print head 11 within the housing 10 such that the print head 11 lies between the dispensing and take-up rolls 20 and 21. One end of the take-up roll 21 is provided with a gear wheel 23 to allow it to engage the transmission mechanism of the printer. This transmission mechanism, which will be described in more detail later, comprises a series of gears 24 (FIG. 3) designed to drive the platen and the take-up roll. The ink ribbon 19 is fed on a 1:1 ratio with the paper 50 to be printed and is sufficient to print approximately 90 sheets of A4 paper.

In this connection it is to be understood that the term "ribbon" is used for convenience even though the ink ribbon 19 has the same width as the paper 50 being printed and is fed in the same direction as the paper 50. Thus, the use of the term ribbon is not intended to imply dimensional or directional limitations.

The cylindrical platen 17 is rotatably mounted inside a trough 25 of generally triangular cross-section which has an open base (see FIGS. 5 to 7) to expose the underside of the platen 17 to the pressure of the print head 11. The platen 17 is used to friction feed the paper 50 to be printed down one side 26 of the trough 25, past the open base at the bottom of the trough and across the print head 11, and up the other side 27 of the trough 25. The end of the platen 27 is provided with a gear wheel 28 to enable it to engage the transmission mechanism 24 of the printer.

The transmission mechanism comprises a gear train 24, FIGS. 6 and 7, driven by a motor (not shown) housed behind the interior sidewall 70, i.e. in the part 71 of the housing. The motor drives the small gear wheel 72, and this motion is transmitted along the gear train which includes intermediate gear wheels 73, 74 and 75 (not all intermediate gear wheels are shown) and a final coaxial pair of gear wheels 76 and 77 which are arranged as a friction clutch. The gear wheel 76 is positively driven by the small intermediate gear wheel 75, but the gear wheel 77 is driven by frictional engagement with the gear wheel 76, being maintained in frictional contact therewith by a spring 78.

In use the gear wheel 28 engages and is driven by the gear wheel 74 to drive the platen 17, and the gear wheel 23 (see also FIG. 2) engages and is driven by the gear wheel 77 to drive the take up roll 21 of the ink ribbon cartridge 22. In operation a recess 37 in lever arm 29 acts to keep gear wheel 23 in contact with gear wheel 77. The friction clutch arrangement of the gear wheels 76 and 77 allows slippage of the gears 76, 77 as necessary to allow for the varying diameter of the take up roll 21 as printing progresses. This keeps the ink ribbon in tension between the platen 17 and take up roll 21, while allowing the platen 17 to determine the rate of feeding both the paper 50 and ink ribbon 19.

The platen 17 is so mounted in relation to the print head 11 and the strength of the springs 14 to provide the necessary pressure against the print head 11 to ensure correct transfer of the printed image. In this connection it is to be noted that in this embodiment the torque needed to drive the platen 17 is substantially the same in the forward and reverse directions of the paper 50, so that it is relatively easy for the printer to drive the paper in the reverse direction. This is advantageous if, for example, it is desired to print double sized lines of characters. In this case, the bit map of a character, used to define those elements of the print head 11 to be energised, is calculated from a datum at the bottom of the character. Thus, it is necessary first to advance the sheet to be printed to allow the lower portion of the character to be printed and then to reverse the paper 50 to print the top portion of the character.

In the present case making the forward and reverse torques equal is facilitated by, amongst other things, (i) having the axis of the coil springs 14 intersect or at least pass very close to the axis of rotation of the platen 17 and also intersect the print head 11 at or close to the array of heating elements 16, and (ii) deflecting the ink ribbon 15 away from the platen 17 as soon as possible after printing, for example by providing a downwardly pointing deflection flange 79 on the trough 25, as shown in FIG. 5.

At each end the trough 25 has a respective leg 29, known as a bailing arm, whose free end is pivotally mounted on a stud 45 integral with the internal frame 46 of the printer. As seen in FIGS. **4*b*, 6 and 7, this allows the platen 17 and trough 25 to be lifted upwards by rotation of the bailing arms 29 about the studs 45 to expose the cartridge 22**, thus permitting the cartridge to be replaced.

With the platen 17 fully raised the cartridge 22 is simply eased out of the printer by lifting the front edge of the cartridge 22 at the points 80 (FIG. 6) one at either end of the supply roll 20 and drawing it upwardly and forwardly so that the rear edge (take up roll 21) is withdrawn from under the raised platen 17. The complete cartridge 22 may then be replaced, or new rolls 20 and 21 slotted into the same cartridge frame.

The platen 17 is locked into position by a lever 30 mounted at each end of the trough 25 for rotation about the axis of rotation of the platen 17. Each lever 30 is formed with a cam 31 such that when the lever is extending generally upwardly and the platen and trough are lowered towards the internal frame 46 of the printer by rotation of the bailing arms 29 about the studs 45, the cam 31 is able to slide down the narrow portion 47 (FIG. **4*c*) of a keyhole slot 32 provided in the internal frame 46 of the printer. The platen and trough are then locked in position by pushing each lever 30 down (i.e. rotating it by approximately 90 degrees) so that the wider sides of the cam 31 then engage in the wider part 48 of the keyhole slot 32 behind the narrow portion 47, as shown in dashed outline in FIG. 4*c***.

It will be seen in FIG. 7 that the apertures 81 in the bailing arms 29 which are engaged by the studs 45 are slightly elongated. This is to provide a slight tolerance when lowering the platen 17, to permit the cams 31 readily to locate in their keyhole slots 32.

The platen 17 has an internal steel rod (not shown) extending along its axis, and the opposite ends of the rod project through respective apertures in the opposite end walls 49 of the trough. The levers 30 are mounted respectively on the projecting ends of the rod. The internal surfaces of the apertures in the trough walls through which the rod passes, and the internal surfaces of the levers 30 which engage the rod, are coated with PTFE to serve bearings for the rod.

The printer has a lid 33 which is located in position along one edge by studs 43 engaging corresponding slots (not shown) in the housing 10, and then clipped into position along the other edge with resilient flaps 44. The lid 33 has two slots 34 parallel to the axis of the rotatable platen 17. These allow the paper 50 to be fed around the platen 17 from outside the printer housing, as already described.

Control information for selectively energising the heating elements of the print head 11, as the ink ribbon 19 and paper 50 are moved past the print head, is fed to the print head 11 from a printed circuit board (PCB, not shown) mounted on the base of the housing via multipin connectors 18. The PCB also controls the rotation of the printer transmission mechanism 24, which drives the ink ribbon 19 and the platen 17. Since the control of the print head and transmission mechanism 24 is essentially the same as in conventional printers, it does not need further description here.

In this embodiment the ink ribbon 19 comprises a polyester film substrate approximately 0.01 millimeters thick, which is coated on its surface facing the paper 50 with an ink which has a melting point in the range 70–90 degrees centigrade. The polyester film may be polyethylene glycol terephthalate, and the ink coating may comprise finely divided carbon black as pigment dispersed in a mixture of natural and synthetic waxes, such as beeswax and polythene wax, the relative proportions of the two types of wax being selected to provide the desired melting point. A typical formulation uses 72% by weight finely divided carbon black, 13% by weight beeswax and 15% by weight polythene wax. The thickness of the ink coating may be only a few microns. Preferably a release layer a few molecules thick is provided on the polyester film substrate prior to coating it with the ink, so as to facilitate transfer of the ink to the paper 50 when melted. The release layer may be a polymer-based substance made up from acrylics, epoxies, cellulose derivatives, vinylics and silicone, as is known in the art. A typical release layer has the following percentages by weight:

| | |
|---|---|
| acrylics | 3.0% |
| epoxies | 28.0% |
| cellulose derivatives | 66.5% |
| vinylics | 0.5% |
| silicone | 2.0% |

While the printer is primarily designed for use with an ink ribbon 19 as aforesaid, it may alternatively use heat sensitive (FAX) paper. In such case, the cartridge 22 is removed. The roll of heat sensitive paper may be contained within the housing 10, being fed between the platen 17 and the print head 11 and out through the dispensing side 27 of the trough 25.

Adding a suitable card will thus allow this printer to be used as a plain or heat sensitive paper modem.

The invention is not limited to the embodiments described herein which may be modified or varied without departing from the scope of the invention.

I claim:

1. A printer comprising:

a housing;

a lid for the housing, said lid being openable to expose the interior of the housing;

an elongated through mounted in the housing below the lid, the trough having upwardly divergent side walls and an open base;

a platen rotatably mounted in the trough with its axis substantially parallel to the longitudinal direction of the trough and part of its circumference exposed at the open base of the trough, the side walls of the trough forming together with the platen respective entrance and exit slots for guiding a sheet of paper down around the underside of the platen for printing and then up from said platen after printing, and wherein the lid has aperture means in register with the slots to permit passage of said sheet to and from the slots from outside the housing;

an ink ribbon cartridge assembly removably mounted in the housing, said ribbon cartridge assembly including dispensing and take up rolls mounted on opposite sides of the platen, each roll having its axis of rotation substantially parallel to the axis of the platen, said ribbon cartridge assembly further including an ink ribbon extending under the platen between the dispensing and the take up rolls;

a print head mounted below the platen;

means for biasing the print head upwardly towards the platen so as to press the ink ribbon and a sheet of paper to be printed on against the underside of the platen; and means mounting said trough for rotation about an axis laterally offset from the trough for rotation of the trough upwardly away from the ink ribbon when the lid of the housing is opened to permit removal and replacement of the ink ribbon cartridge.

2. A printer as claimed in claim 1 wherein the print head is elongated in a direction substantially parallel to the axis of the platen.

3. A printer as claimed in claim 2 wherein the biasing means comprises a plurality of coil springs under compression below the print head, the axis of each spring passing through the print head and intersecting or passing close to the axis of the platen.

4. A printer as claimed in claim 1 wherein mounting means for the trough comprises two arms which are pivoted relative to the housing, the trough being movable upwardly away from the ink ribbon by pivoting the arms carrying the trough.

5. A printer as claimed in claim 1 wherein each of the take up roll and platen has a respective gear wheel at one end, wherein the printer has a gear train for driving both the platen and the take up roll, and wherein a friction clutch drives the take up roll.

* * * * *

UNITED STATES PATENT AND TRADEMARK OFFICE

CERTIFICATE OF CORRECTION

PATENT NO. : 5,228,793
DATED : July 20, 1993
INVENTOR(S) : John J. Ferrie

It is certified that error appears in the above-indentified patent and that said Letters Patent is hereby corrected as shown below:

Column 1, line 45;

After "platen 17" insert --.--.

Column 5, line 31, claim 1;

"through" should be --trough--.

Column 6, line 31, claim 4;

After "wherein" insert --the--.

Signed and Sealed this

Third Day of May, 1994

Bruce Lehman

*Attest:*

BRUCE LEHMAN

*Attesting Officer*

*Commissioner of Patents and Trademarks*